US009570847B2

(12) United States Patent
Hung et al.

(10) Patent No.: US 9,570,847 B2
(45) Date of Patent: Feb. 14, 2017

(54) FIXED STRUCTURE FOR INTERFACE CARD

(71) Applicant: Innodisk Corporation, New Taipei (TW)

(72) Inventors: Hsin-Jung Hung, New Taipei (TW); Hsiao-Yu Wang, New Taipei (TW)

(73) Assignee: INNODISK CORPORATION, New Taipei (TW)

( * ) Notice: Subject to any disclaimer, the term of this patent is extended or adjusted under 35 U.S.C. 154(b) by 0 days.

(21) Appl. No.: 15/088,433

(22) Filed: Apr. 1, 2016

(65) Prior Publication Data

US 2016/0308306 A1 Oct. 20, 2016

(30) Foreign Application Priority Data

Apr. 16, 2015 (TW) ..... 104112162 A

(51) Int. Cl.
*H01R 13/627* (2006.01)
*H01R 12/73* (2011.01)

(52) U.S. Cl.
CPC ..... *H01R 13/6275* (2013.01); *H01R 12/737* (2013.01)

(58) Field of Classification Search
CPC ..... H01R 13/6275; H01R 12/737
USPC ..... 439/357, 358, 372, 353, 352, 350, 296
See application file for complete search history.

(56) References Cited

U.S. PATENT DOCUMENTS 4,008,942 A * 2/1977 Grossi ..... H05K 7/1405 361/690
4,198,024 A * 4/1980 Cavanna ..... H05K 7/1405 211/41.17
5,154,627 A * 10/1992 Lee ..... H01R 12/7005 439/326
5,169,333 A * 12/1992 Yang Lee ..... H05K 7/1431 439/326
5,494,451 A * 2/1996 Bowers ..... H01R 12/7005 439/328
5,660,557 A * 8/1997 Lemke ..... H01R 12/7005 439/328
6,354,881 B1 * 3/2002 Bricaud ..... G06K 7/0021 235/475
6,769,927 B2 * 8/2004 Brewer ..... H01R 12/721 439/328
7,364,447 B1 * 4/2008 Desrosiers ..... G06F 1/186 439/157
2013/0109240 A1 * 5/2013 Chiang ..... H01R 12/7029 439/630

(Continued)

*Primary Examiner* — Abdullah Riyami
*Assistant Examiner* — Nelson R Burgos-Guntin
(74) *Attorney, Agent, or Firm* — Chun-Ming Shih

(57) ABSTRACT

The invention provides a fixed structure for an interface card. The interface card is fixed within an interface slot by the fixed structure. The interface slot is provided on a front side therefore with at least one protruding block. The fixed structure comprises a metal shell, which is assembled to a surface of the interface card, and comprises a pressing portion and an engaging portion. When the interface card is to be inserted into the interface card, the user presses the pressing portion of the metal shell so as to expand the engaging portion. When the interface card has been inserted into the interface card, the user will release the pressing portion of the metal shell so that the engaging portion can engage with the protruding block of the interface slot. Therefore, the interface card is steady fixed within the interface slot by means of the fixed structure.

10 Claims, 6 Drawing Sheets

(56) References Cited

U.S. PATENT DOCUMENTS

2014/0242828 A1* 8/2014 Gong ..... H01R 13/6392
439/357
2016/0308306 A1* 10/2016 Hung ..... H01R 12/737

* cited by examiner

FIXED STRUCTURE FOR INTERFACE CARD

CROSS-REFERENCE TO RELATED APPLICATIONS

This non-provisional application claims priority claim under 35 U.S.C. §119(a) on Taiwan Patent Application No. 104112162 filed Apr. 16, 2015, the entire contents of which are incorporated herein by reference.

FIELD OF THE INVENTION

The present invention relates to a fixed structure for an interface card, particularly to a simple structure having integrally formed, and capable of fixing the interface card within an interface slot.

BACKGROUND

FIG. 1 is a stereogram construction diagram of an interface card inserted into an interface slot according to the prior art. As shown in FIG. 1, an interface card 111 is able to insert into an interface slot 131 provided on a motherboard 13. When the interface card 111 is inserted into the interface slot 131 of the motherboard 13, the motherboard 13 may transmit data to the interface card 111 via the interface slot 131, so as to expand the function of the motherboard 13.

The convention interface card 111 has a side edge provided with a baffle 113. When the interface card 111 is inserted into the interface slot 131, the baffle 113 is forced into contact with the computer case 15. Afterward, the baffle 113 and the computer case 15 are able to lock together via a screw 115, so that the interface card 111 can be fixed on the computer case 15.

In the past, when the interface card 111 prepares to install to the computer host, the user must insert the interface card 111 into the interface slot 131 and micro-adjust the position of the interface card 111 to align the baffle 113 of the interface card 111 with a specific hole provided on the computer case 15, and then lock the screw 115 between the baffle 113 and the specific hole of the computer case 15 by the use of screwdriver, so that the baffle 113 of the interface card 111 can be fixed on the computer case 15. Further, when disassembling the interface card 111, the user needs also to use the screwdriver to remove the screw 115 between the baffle 113 and the specific hole of the computer case 15 for allowing removal of the interface card 111 from the interface slot 131. Accordingly, whether the convention interface card 111 is installed within the computer host or removed from the computer host, the screwdriver must be used to assist in locking or removing operation of the screw. Therefore, the installation or disassembly procedure of the convention interface card 111 is inconvenience.

Besides, the baffle 113 of the interface card 111 is configured subject to a predetermined specification, for example, a height of a standard baffle is 121 mm or a height of a short baffle is 79.4 mm. Thus, the size of the baffle 113 is not adjustable subject to the height H of the interface card 111. The size specification of the baffle 113 will be a barrier for the computer host desirous of light, thin, short and small characteristics. Further, because the interface card 111 is fixed to the interface slot 131 of the computer case 15 via the baffle 113, the location of the interface slot 131 on the motherboard 13 must be provided relative to the locations of the baffle 113 and the computer case 15, or the interface card 111 will not be fixable to the computer case 15. Thus, when the designer is designing the motherboard 13, the designer cannot freely change the location of the interface slot 131, which will be limiting the flexibility of the arrangements of members of the computer host, and the design of the circuit layout of the motherboard 13.

SUMMARY

It is one object of the present invention to provide a fixed structure for an interface card. The fixed structure comprises a metal shell having integrally formed characteristic. The metal shell is assembled to a surface of the interface card, and comprises a pressing portion and an engaging portion. When the interface card prepares to install into the interface slot having at least one protruding block, the user is able to press the pressing portion of the metal shell so as to expand the engaging portion. When the interface card has been installed and inserted into the interface card, the user will release the pressing portion of the metal shell so that the engaging portion engages with the protruding block of the interface slot. Therefore, the interface card is steady fixed within the interface slot by means of the fixed structure.

It is other object of the present invention to provide a fixed structure for an interface card. The fixed structure comprises a first metal shell and a second metal shell. The first metal shell is a main engaging member, and the second metal shell is an auxiliary engaging member. The first metal shell is assembled to a surface of the interface card, and comprises a pressing portion and an engaging portion, and the second metal shell is assembled to other surface of the interface card, and comprises a body portion and an extension portion. When the interface card prepares to install into the interface slot having at least one protruding block, the user is able to press the pressing portion of the first metal shell so as to expand the engaging portion. Afterward, when the interface card has been inserted into the interface slot, the user will release the pressing portion of the first metal shell so that the engaging portion of the first metal shell can be tighten to close and clamp the protruding block of the interface slot, and thus engage with the protruding block of the interface slot along Z-axis direction. At this same time, the extension portion of the second metal shell will be affixed to the rear side, and left and right sides of the interface slot to generate a supporting force in the back of the interface card. The supporting force will prevent the interface card to tilt and shake towards the back so that the interface card is fixed along X and Y-axis direction. Thereby, the interface card is steady inserted within the interface slot via the engaging force that is generated by the engaging portion of the first metal shell engaging with the protruding block of the interface slot along Z-axis direction, and the supporting force that is generated by the extension portion of the second metal shell affixing to the rear side, and left and right sides of the interface slot along X and Y-axis direction.

It is another object of the present invention to provide a fixed structure, in which comprises at least one metal shell used for fixing the interface card within the interface slot. Further, the metal shell is a thin metal shell. Because of the metal shell of the fixed structure being designed as the form of thin, it will be able to prevent the metal shell collided with other members provided on the motherboard so as to avoid to influence the insertion operation between the interface card and the interface slot.

For achieving above objects, the present invention provides a fixed structure for an interface card, wherein the interface card is fixed within an interface slot by the fixed structure, at least one protruding block is provided on a front side of the interface slot, the fixed structure comprising: a first metal sheet, being a thin metal sheet having integrally formed, assembled on a surface of the interface card, and comprising a first pressing portion and a first engaging portion, wherein a first open space is defined between the first pressing portion and a body of the first metal sheet, the first pressing portion having a bottom end connected to the first engaging portion, and a top end bended and extended toward an outside of the first open space; wherein the first pressing portion moves toward an inside of the first open space when the top end of the first pressing portion is pressed, and the first engaging portion engages with the protruding block of the interface slot when the interface card is inserted into the interface slot.

In one embodiment of the present invention, wherein when the interface card prepares to pull out from the interface slot, pressing the top end of the first pressing portion to move toward the inside of the first open space, resulting in the first engaging portion capable of appearing a expanded form and disengaging from the protruding block of the interface slot.

In one embodiment of the present invention, further comprising a second metal sheet assembled on other surface of the interface card, wherein the second metal sheet comprises a body portion and a extension portion extended from a bottom end of the body portion, the extension portion of the second metal sheet is affixed to a rear side of the interface slot when the interface card is fixed within the interface slot by the fixed structure.

In one embodiment of the present invention, wherein the extension portion of the second metal sheet is provided on one or two of left and right sides thereof with at least one cladding portion, the cladding portion is connected to the extension portion in an approximate vertical angle, sthe cladding portion of the second metal sheet is affixed to one or two of left and right sides of the interface slot when the interface card is fixed within the interface slot by sthe fixed structure.

In one embodiment of the present invention, wherein the first pressing portion and the first engaging portion are integrally formed by stamping the first metal sheet.

In one embodiment of the present invention, wherein the body portion, the extension portion, and the cladding portion are integrally formed by stamping the second metal sheet.

In one embodiment of the present invention, further comprising a fixed assembly, the fixed assembly comprising a plurality of fixed columns and a plurality of fixed members, each of fixed columns is a hollow column, and fixed on an inner surface of the first metal sheet, wherein the interface card is further provided with a plurality of holes, the fixed members are combined with the corresponding fixed columns via the holes of the interface card.

In one embodiment of the present invention, further comprising a fixed assembly, the fixed assembly comprising a plurality of fixed columns and a plurality of fixed members, each of fixed columns is a hollow column, and fixed on an inner surface of the first metal sheet, wherein the interface card and the second metal sheet are further provided with a plurality of holes, the fixed members are combined with the corresponding fixed columns via the holes of the interface card and the second metal sheet.

The present invention also provides another fixed structure for an interface card, wherein the interface card is fixed within an interface slot by the fixed structure, a plurality of protruding blocks are provided on a front side and a rear side of the interface slot, respectively, the fixed structure comprising: a first metal sheet, being a thin metal sheet having integrally formed, assembled on a surface of the interface card, and comprising a first pressing portion and a first engaging portion, wherein a first open space is defined between the first pressing portion and a body of the first metal sheet, the first pressing portion having a bottom end connected to the first engaging portion, and a top end bended and extended toward an outside of the first open space; and a second metal sheet, being also a thin metal sheet having integrally formed, assembled on other surface of the interface card, and comprising a second pressing portion and a second engaging portion, wherein a second open space is defined between the second pressing portion and a body of the second metal sheet, the second pressing portion having a bottom end connected to the second engaging portion, and a top end bended and extended toward an outside of the second open space; wherein the first pressing portion moves toward an inside of the first open space when the top end of the first pressing portion is pressed, the second pressing portion moves toward an inside of the second open space when the top end of the second pressing portion is pressed; wherein the first engaging portion and the second engaging portion engage with the protruding blocks of the interface slot when the interface card is inserted into the interface slot.

In one embodiment of the present invention, further comprising a fixed assembly, the fixed assembly comprising a plurality of fixed columns and a plurality of fixed members, each of fixed columns is a hollow column, and fixed on an inner surface of the first metal sheet, wherein the interface card and the second metal sheet are further provided with a plurality of holes, the fixed members are combined with the corresponding fixed columns via the holes of the interface card and the second metal sheet.

DETAILED DESCRIPTION OF THE PREFERRED EMBODIMENTS

Figure 1:
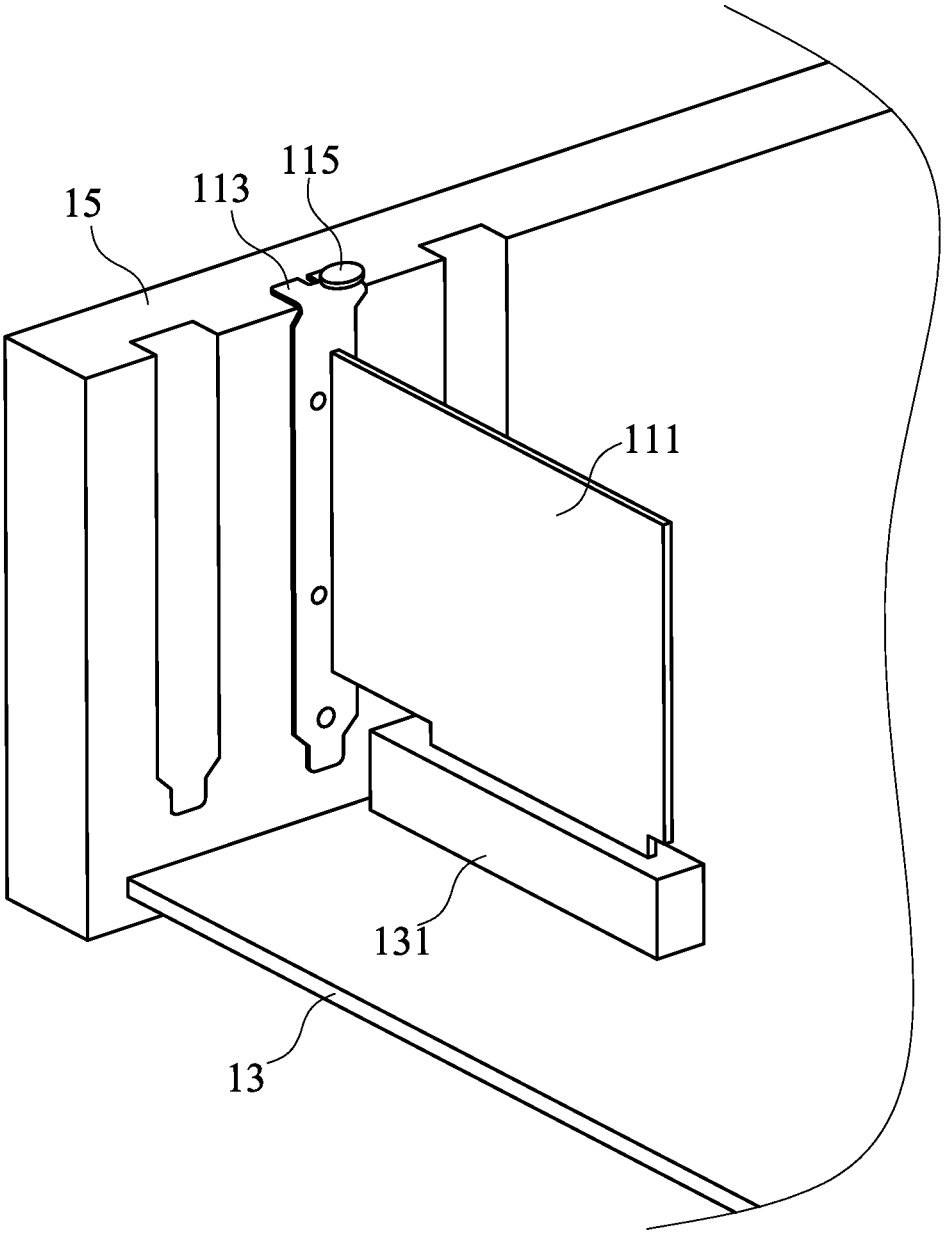
FIG. 1 (PRIOR ART)
FIG. 1 is a stereoscopic construction diagram of an interface card inserted into an interface slot according to the prior art.
Figure 2:
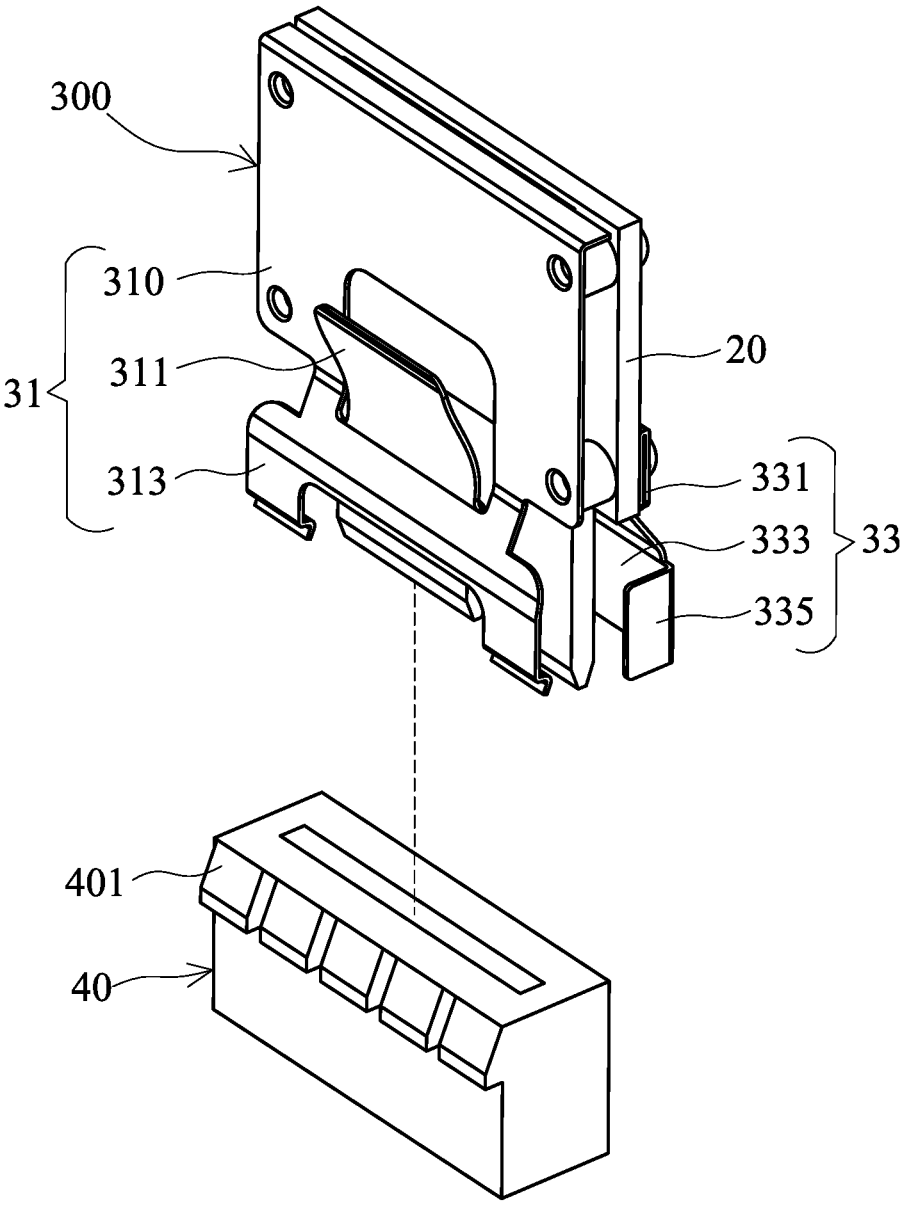
FIG. 2 is a stereoscopic construction diagram of a fixed structure for an interface card being separated form an interface slot according to one embodiment of the present invention.
Figure 3:
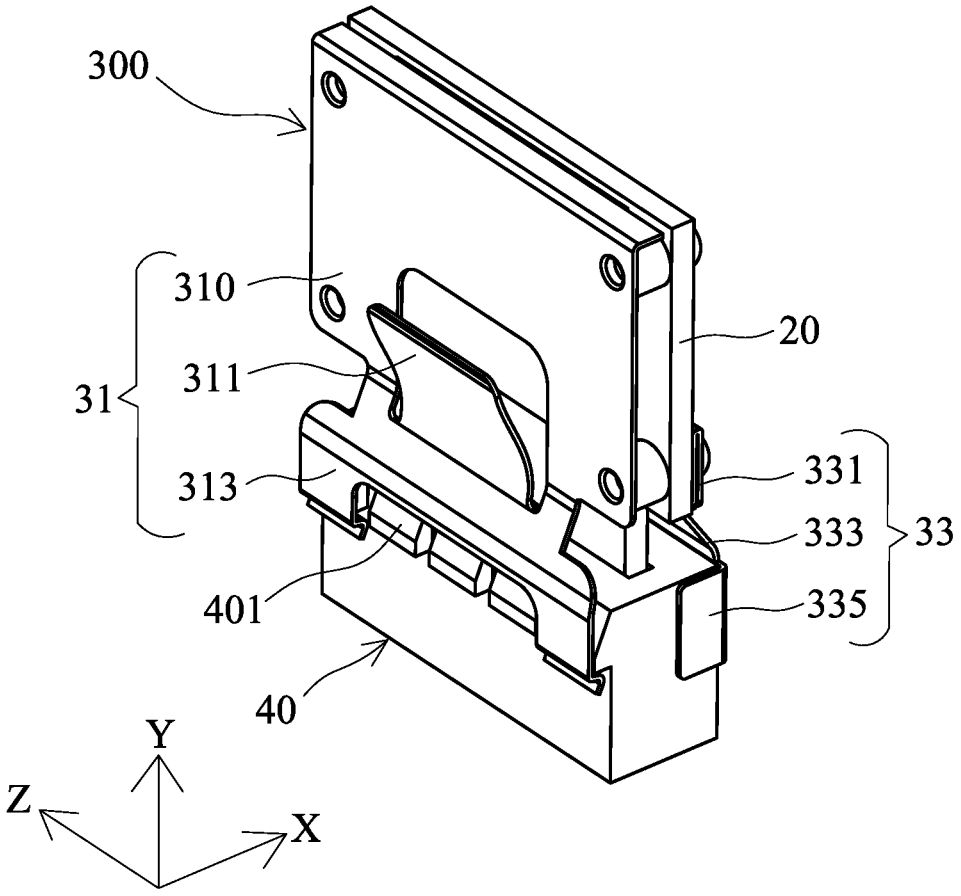
FIG. 3 is a stereoscopic construction diagram of the fixed structure for the interface card being combined with the interface slot according to one embodiment of the present invention.
Figure 4:
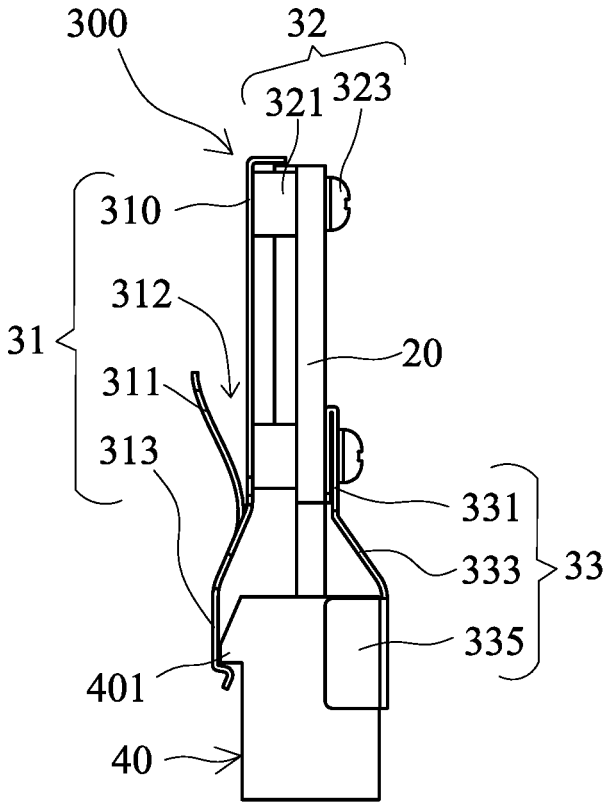
FIG. 4 is a sectional side construction diagram of the fixed structure for the interface card being combined with the interface slot according to one embodiment of the present invention.
Figure 5:
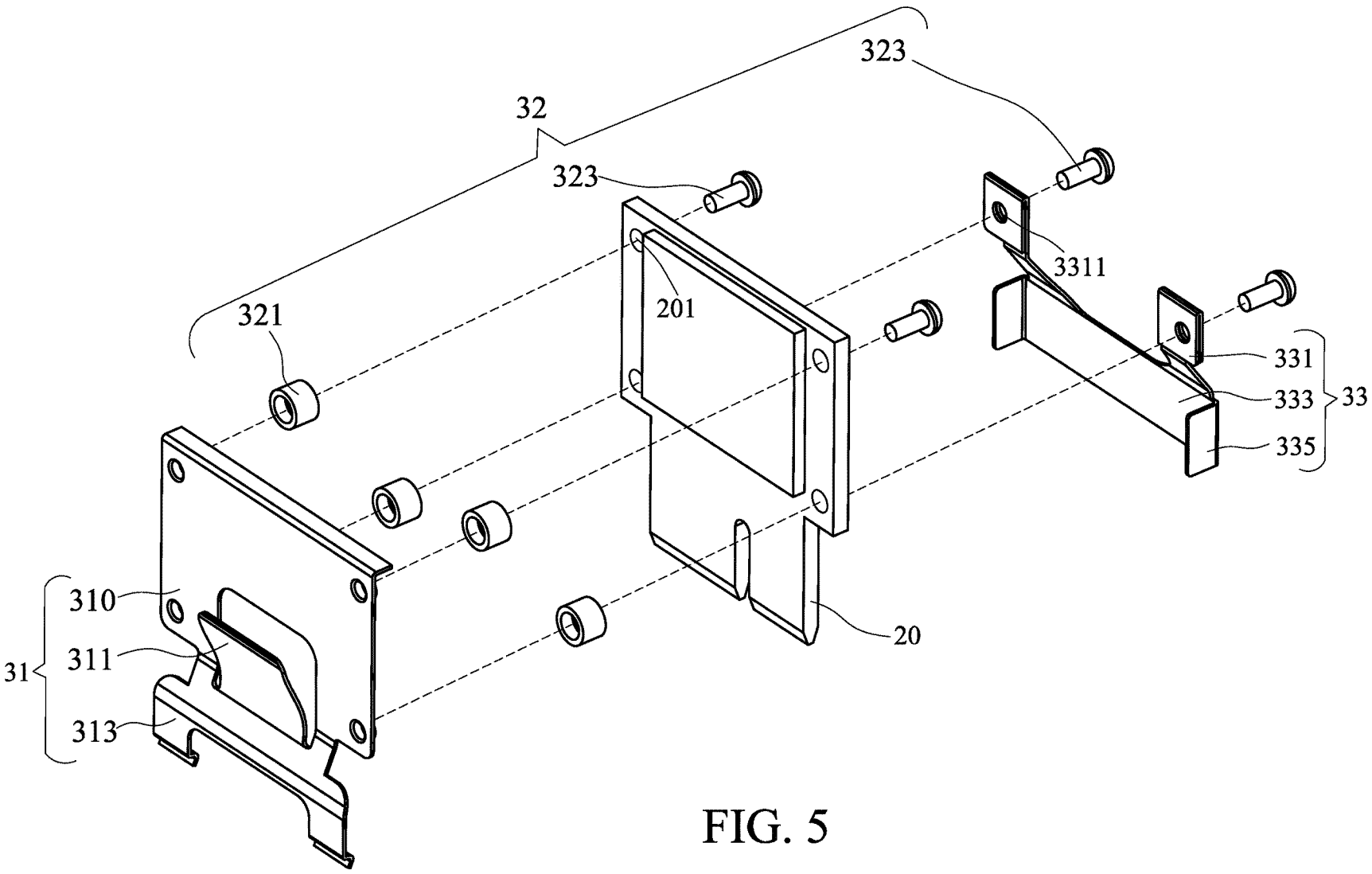
FIG. 5 is an explosion construction diagram of the fixed structure for the interface card according to one embodiment of the present invention.

Referring to FIGS. 2, 3, 4 and 5, there are shown a stereoscopic construction diagram of a fixed structure for an interface card being separated form an interface slot, a stereoscopic construction diagram of the fixed structure for the interface card being combined with the interface slot, a sectional side construction diagram of the fixed structure for the interface card being combined with the interface slot, and an explosion construction diagram of the fixed structure for the interface card according to one embodiment of the present invention. In the present invention, an interface card 20 is fixed within an interface slot 40 provided on a motherboard. The interface slot 40 is an interface slot conforming to PCIe (Personal Computer Interface Express) interface standard specification or other interface standard specification. Besides, at least one protruding block 401 is provided on a front side of the interface slot 40.

In one embodiment of the present invention, the fixed structure 300 comprises a first metal shell 31. The first metal shell 31 is assembled to a surface, for example, front surface, of the interface card 20. The first metal shell 31 comprises a body 310, a first pressing portion 311, and at least one first engaging portion 313. A first open space 312 is defined between the first pressing portion 311 and the body 310. Besides, the first pressing portion 311 has a bottom end connected to the first engaging portion 313, and a top end bended and extended toward an outside of the first open space 312. The first pressing portion 311 will move toward the inside of the first open space 312 when the user presses the top end of the first pressing portion 311.

If the interface card 20 prepares to install to the interface slot 40, the interface card 20 taken by the user to align the position of the interface slot 40, and then insert into the inside of the interface slot 40, in such a way that the interface card 20 may be installed within the interface slot 40. Afterward, the motherboard of the computer may transmit data to the interface card 20 via the interface slot 40. When the interface card 20 has been inserted into the interface card 40, the first engaging portion 313 will engage with the protruding portion 401 of the interface slot 40, so that the interface card 20 is steady installed within the interface slot 40, and not easily loosened from the interface slot 40.

Further, during the fixed structure 300 prepares to be fixed within the interface slot 40, the user presses the top end of the first pressing portion 311 to make the first pressing portion 311 capable of moving toward the inside of the first open space 312, resulting in the first engaging portion 313 being forced to reverse move corresponding to the moving direction of the first pressing portion 311 so as to expand the first engaging portion 313. Afterward, when the interface card 20 inserted into the interface slot 40 has been confirmed, the user will release the first pressing portion 311 so that the first engaging portion 313 can be tighten to close and clamp the protruding block 401 of the interface slot 40, and thus engage with the protruding block 401 of the interface slot 40 along Z-axis direction.

Otherwise, the user may also hold parts of the surface of the interface card 20 and the body 310 of the first metal shell 31, and directly insert the interface card 20 into the inside of the interface slot 40. When the interface card 20 continued downward into the inside of the interface slot 40, the first engaging portion 313 of the first metal shell 31 will be expanded according to the appearance of the protruding portion 401. Continually, after the interface card 20 has been entered the deep of the interface slot 40, the first engaging portion 313 will be moved to the bottom edge of the protruding portion 401 so that the expanded state of the first engaging portion 313 will be retracted, and therefore the first engaging portion 313 is capable of closely engaging with the protruding block 401.

On the contrary, during the fixed structure 300 prepares to be disassembled from the interface slot 40, the user presses the top end of the first pressing portion 311 to make the first pressing portion 311 capable of moving toward the inside of the first open space 312, resulting in the first engaging portion 313 being forced to reverse move corresponding to the moving direction of the first pressing portion 311 so as to expand the first engaging portion 313. Simultaneously, the user holds part of the surface of the interface card 20 and/or the body 310 of the first metal shell 31, and then picks up the interface card 20, in such a way the interface card 20 disengaged from the interface slot 40, so as to finish the disassembled process.

For achieving the design requirement of light, thin, short and small characteristics of the computer host, the board area of the currently computer motherboard is gradually downsizing. A variety of standard interface slots (for example, PCIe, USB, SATA, IDE, etc.), or electrical elements are provided on the restricted board area, their disposition location will be very close to each other. Accordingly, For avoiding the fixed structure 300 assembled on the interface card 20 to collide with other adjacent interface slots or electrical elements, the first metal shell 31 of the fixed structure 300 will be made into a thin metal sheet, for example, the thickness of the first metal shell 31 below 0.3 mm. And, a stamping way is adopted for the making of the first metal shell 31 so that the body 310, the first pressing portion 311, and the first engaging portion 313 are integrally formed on the first metal shell 31. Due to the first metal shell 31 being made as thinness, it will be able to prevent the fixed structure 300 collided with other standard interface slots or electrical elements on the motherboard of computer, and further avoid to influence the insertion operation between the interface card 20 and the interface slot 40.

In one embodiment of the present invention, the first metal shell 31 is assembled to the surface of interface card 20 by means of bonding or welding. In other embodiment of the present invention, the fixed structure 300 further comprises a fixed assembly 32; accordingly, the first metal shell 31 is able to assemble to the surface of the interface card 20 by the use of the fixed assembly 32. The fixed assembly 32 comprises a plurality of fixed columns 321 and a plurality of fixed members 323. Each of fixed columns 321 is a hollow column having thread, and fixed on an inner surface of the first metal sheet 31, respectively. Each of fixed members 323 is a screw element. A plurality of holes 201 are drilled on the interface card 20. When the first metal shell 31 is to be assembled to the interface card 20 by the fixed assembly 32, firstly, each of fixed columns 321 fixed on the first metal shell 31 will align to each of corresponding holes 201, and then the fixed members 323 are combined with the fixed columns 321 via the holes 201 so that the first metal shell 31 can be assembled on the interface card 20. Furthermore, although the fixed columns 321 and the fixed members 323 of the present invention take the hollow columns having thread and the screw elements as the specific embodiment, respectively, person of ordinary skill in the art should understand, they are only the components that can embedded or locked together, all should be included in the claims of the present invention.

In another embodiment of the present invention, the fixed structure 300 further comprises a second metal shell 33. The second metal shell 33 is assembled to other surface, for example, rear surface, of the interface card 20. The second metal shell 33 comprises a body portion 331 and an extension portion 333. The extension portion 333 is connected to the bottom end of the body portion 331. When the interface card 20 has been fixed within the interface slot 40 by the fixed structure 300, the extension portion 333 of the second metal shell 33 will be affixed to the rear side of the interface slot 40 to generate a supporting force in the back of the interface card 20. The supporting force will prevent the interface card 20 to tilt and shake backward so that the interface card 20 is fixed along X and Y-axis direction. Thereby, the interface card 20 is steady inserted within the interface slot 40 via the first engaging force that is generated by the first engaging portion 313 of the first metal shell 31 engaging with the protruding block 401 of the interface slot 40 along Z-axis direction, and the supporting force that is generated by the extension portion 333 of the second metal shell 33 affixing to the rear side of the interface slot 40 along X and Y-axis direction.

In another embodiment of the present invention, the extension portion 333 of the second metal sheet 33 is provided on one or two of left and right sides thereof with at least one cladding portion 335. The cladding portion 335 is connected to the extension portion 333 in an approximate vertical angle. When the interface card 20 has been fixed within the interface slot 40 by the fixed structure 300, the cladding portion 335 of the second metal sheet 33 is affixed to one or two of left and right sides of the interface slot 40. By the disposition of the cladding portion 335, it can enhance the supporting force exerted to the interface card 20 along Z-axis direction.

Of course, the second metal shell 33 of the present invention will be also made into a thin metal sheet, for example, the thickness of the second metal shell 33 below 0.3 mm. And, a stamping way is adopted for the making of the second metal shell 33 so that the body portion 331, the extension portion 333, and/or the cladding portion 335 are integrally formed on the second metal shell 33. Due to the first metal shell 31 as well as the second metal shell 33 being made as thinness, it will be able to prevent the fixed structure 300 collided with other standard interface slots or electrical elements on the motherboard of computer, and further avoid to influence the insertion operation between the interface card 20 and the interface slot 40.

In one embodiment of the present invention, the second metal shell 33 is assembled to the surface of interface card 20 by means of bonding or welding. Otherwise, in other embodiment of the present invention, a plurality of holes 3311 are provided on the body portion 331 of the second metal sheet 33. The fixed members 323 are combined with the corresponding fixed columns 321 via the holes 3311 201 on the second metal sheet 33 and the interface card 20 so that the first metal shell 31 and the second metal shell 33 can be assembled on the interface card 20.

Figure 6:
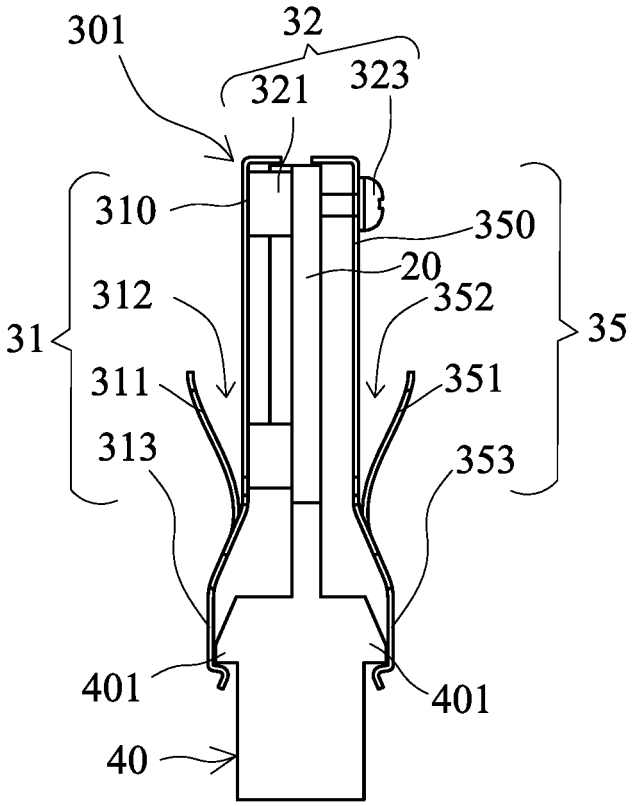
FIG. 6 is a sectional side construction diagram of the fixed structure for the interface card being combined with the interface slot according to other embodiment of the present invention.

Referring to FIGS. 6, there is shown a sectional side construction diagram of the fixed structure for the interface card being combined with the interface slot according to other embodiment of the present invention. As shown in FIG. 6, the fixed structure 301 further comprises a second metal shell 35 except the first metal shell 31. The appearance structure of the second metal shell 35 is reflection symmetric with respect to the appearance structure of the first metal shell 31. The second metal shell 35 is assembled to other surface, for example, rear surface, of the interface card 20. The second metal shell 35 comprises a body 350, a second pressing portion 351, and at least one second engaging portion 353. A second open space 352 is defined between the second pressing portion 351 and the body 350. A plurality of protruding blocks 401 are provided on a front side and a rear side of the interface slot 40, respectively. Besides, the second pressing portion 351 has a bottom end connected to the second engaging portion 353, and a top end bended and extended toward an outside of the second open space 352. The second pressing portion 351 will move toward the inside of the second open space 352 when the user presses the top end of the second pressing portion 351.

During the fixed structure 301 prepares to be fixed within the interface slot 40, the user can simultaneously press the top ends of the first pressing portion 311 and the second pressing portion 351 to make the first pressing portion 311 and the second pressing portion 351 capable of moving toward the inside of the first open space 312 and the inside of the second open space 352, respectively, resulting in the first engaging portion 313 and the second engaging portion 353 being forced to reverse move corresponding to the moving direction of the first pressing portion 311 and the second pressing portion 351, respectively, so as to expand the first engaging portion 313 and the second engaging portion 353. Afterward, when the interface card 20 inserted into the interface slot 40 has been confirmed, the user will release the first pressing portion 311 and the second pressing portion 351 so that the first engaging portion 313 and the second engaging portion 353 can be tighten to close and clamp the protruding block 401 of the interface slot 40, and thus engage with the protruding blocks 401 of the interface slot 40.

On the contrary, during the fixed structure 301 prepares to be disassembled from the interface slot 40, the user presses the top ends of the first pressing portion 311 and the second pressing 351 to make the first pressing portion 311 and the second pressing portion 351 capable of moving toward the inside of the first open space 312 and the inside of the second open space 352, resulting in the first engaging portion 313 and the second engaging portion 353 being forced to reverse move corresponding to the moving direction of the first pressing portion 311 and the second pressing portion 351 so as to expand the first engaging portion 313 and the second engaging portion 353. Simultaneously, the user holds the body 310 and 350 of the first metal shell 31 and the second metal shell 35 to pick up the interface card 20, in such a way the interface card 20 disengaged from the interface slot 40, so as to finish the disassembled process.

Further, the first metal shell 31 and the second metal shell 35 are able to assemble on the interface card 20 by the use of the fixed assembly 32. When the first metal shell 31 and the second metal shell 35 are to be assembled to the interface card 20 by the fixed assembly 32, firstly, each of fixed columns 321 fixed on the first metal shell 31 will align to each of corresponding holes 201, and then the fixed members 323 are combined with the fixed columns 321 via the holes 201 so that the first metal shell 31 and the second metal shell 35 can be assembled on the interface card 20.

Of course, the second metal shell 35 of the present invention will be also made into a thin metal sheet, for example, the thickness of the second metal shell 35 below 0.3 mm. And, a stamping way is adopted for the making of the second metal shell 35 so that the body 350, the second pressing portion 351, and the second engaging portion 353 are integrally formed on the second metal shell 35. Due to the first metal shell 31 as well as the second metal shell 35 being made as thinness, it will be able to prevent the fixed structure 301 collided with other standard interface slots or electrical elements on the motherboard of computer, and further avoid to influence the insertion operation between the interface card 20 and the interface slot 40.

The above disclosure is only the preferred embodiment of the present invention, and not used for limiting the scope of the present invention. All equivalent variations and modifications on the basis of shapes, structures, features and spirits described in claims of the present invention should be included in the claims of the present invention.

The invention claimed is:

1. A fixed structure for an interface card, wherein said interface card is fixed within an interface slot by said fixed structure, at least one protruding block is provided on a front side of said interface slot, said fixed structure comprising:

a first metal sheet, being a thin metal sheet having integrally formed, assembled on a surface of said interface card, and comprising a first pressing portion and a first engaging portion, wherein a first open space is defined between said first pressing portion and a body of said first metal sheet, said first pressing portion having a bottom end connected to said first engaging portion, and a top end bended and extended toward an outside of said first open space, wherein said first pressing portion moves toward an inside of said first open space when said top end of said first pressing portion is pressed;

wherein said first engaging portion engages with said protruding block of said interface slot when said interface card is inserted into said interface slot.

2. The fixed structure according to claim 1, wherein when said interface card prepares to pull out from said interface slot, pressing the top end of said first pressing portion so that said first pressing portion is moved toward the inside of said first open space, resulting in said first engaging portion capable of appearing a expanded form and disengaging from said protruding block of said interface slot.

3. The fixed structure according to claim 1, further comprising a second metal sheet assembled on other surface of said interface card, wherein said second metal sheet comprises a body portion and a extension portion extended from a bottom end of said body portion, said extension portion of said second metal sheet is affixed to a rear side of said interface slot when said interface card is fixed within said interface slot by said fixed structure.

4. The fixed structure according to claim 3, wherein said extension portion of said second metal sheet is provided on one or two of left and right sides thereof with at least one cladding portion, said cladding portion is connected to said extension portion in an approximate vertical angle, said cladding portion of said second metal sheet is affixed to one or two of left and right sides of said interface slot when said interface card is fixed within said interface slot by said fixed structure.

5. The fixed structure according to claim 1, wherein said first pressing portion and said first engaging portion are integrally formed by stamping said first metal sheet.

6. The fixed structure according to claim 4, wherein said body portion, said extension portion, and said cladding portion are integrally formed by stamping said second metal sheet.

7. The fixed structure according to claim 1, further comprising a fixed assembly, said fixed assembly comprising a plurality of fixed columns and a plurality of fixed members, each of said fixed columns is a hollow column, and fixed on an inner surface of said first metal sheet, wherein said interface card is further provided with a plurality of holes, said fixed members are combined with said corresponding fixed columns via said holes of said interface card.

8. The fixed structure according to claim 3, further comprising a fixed assembly, said fixed assembly comprising a plurality of fixed columns and a plurality of fixed members, each of said fixed columns is a hollow column, and fixed on an inner surface of said first metal sheet, wherein said interface card and said second metal sheet are further provided with a plurality of holes, said fixed members are combined with said corresponding fixed columns via said holes of said interface card and said second metal sheet.

9. A fixed structure for an interface card, wherein said interface card is fixed within an interface slot by said fixed structure, a plurality of protruding blocks are provided on a front side and a rear side of said interface slot, respectively, said fixed structure comprising:

a first metal sheet, being a thin metal sheet having integrally formed, assembled on a surface of said interface card, and comprising a first pressing portion and a first engaging portion, wherein a first open space is defined between said first pressing portion and a body of said first metal sheet, said first pressing portion having a bottom end connected to said first engaging portion, and a top end bended and extended toward an outside of said first open space, wherein said first pressing portion moves toward an inside of said first open space when said top end of said first pressing portion is pressed; and a second metal sheet, being also a thin metal sheet having integrally formed, assembled on other surface of said interface card, and comprising a second pressing portion and a second engaging portion, wherein a second open space is defined between said second pressing portion and a body of said second metal sheet, said second pressing portion having a bottom end connected to said second engaging portion, and a top end bended and extended toward an outside of said second open space, wherein said second pressing portion moves toward an inside of said second open space when said top end of said second pressing portion is pressed;

wherein said first engaging portion and said second engaging portion engage with said protruding blocks of said interface slot when said interface card is inserted into said interface slot.

10. The fixed structure according to claim 9, further comprising a fixed assembly, said fixed assembly comprising a plurality of fixed columns and a plurality of fixed members, each of said fixed columns is a hollow column, and fixed on an inner surface of said first metal sheet, wherein said interface card and said second metal sheet are further provided with a plurality of holes, said fixed members are combined with said corresponding fixed columns via said holes of said interface card and said second metal sheet.

* * * * *